US011142869B2

(12) United States Patent
Sjöström et al.

(10) Patent No.: US 11,142,869 B2
(45) Date of Patent: Oct. 12, 2021

(54) BLADE SEGMENT FOR REFINER

(71) Applicant: Valmet Technologies, Inc., Espoo (FI)

(72) Inventors: Håkan Sjöström, Espoo (FI); Marko Loijas, Espoo (FI); Matti Kaarineva, Espoo (FI); Tomi Iisakkila, Espoo (FI); Markku Partanen, Espoo (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 495 days.

(21) Appl. No.: 15/976,297

(22) Filed: May 10, 2018

(65) Prior Publication Data

US 2018/0327970 A1 Nov. 15, 2018

(30) Foreign Application Priority Data

May 11, 2017 (FI) ..... 20175426

(51) Int. Cl.

| | |
|---|---|
| ***D21D 1/20*** | (2006.01) |
| ***D21D 1/26*** | (2006.01) |
| ***D21D 1/24*** | (2006.01) |
| ***D21D 1/30*** | (2006.01) |

(52) U.S. Cl.

CPC ..... *D21D 1/20* (2013.01); *D21D 1/24* (2013.01); *D21D 1/26* (2013.01); *D21D 1/306* (2013.01)

(58) Field of Classification Search

CPC . B02C 7/12; B02C 7/13; D21D 1/006; D21D 1/008; D21D 1/20; D21D 1/24; D21D 1/26; D21D 1/30; D21D 1/303; D21D 1/306

See application file for complete search history.

(56) References Cited

U.S. PATENT DOCUMENTS

| | | | | |
|---|---|---|---|---|
| 348,637 A * | 9/1886 | Raymond | B02C 7/12 241/296 |
| 1,329,742 A * | 2/1920 | Bausman | A23G 1/04 241/298 |
| 2,035,994 A * | 3/1936 | Sutherland, Jr. | B02C 7/12 241/21 |

(Continued)

FOREIGN PATENT DOCUMENTS

| | | |
|---|---|---|
| CN | 106192524 A | 12/2016 |
| DE | 102004039986 A1 | 12/2007 |

(Continued)

OTHER PUBLICATIONS

Finnish Search Report for FI20175426 dated Dec. 22, 2017.
European Search Report for EP18167496 dated May 25, 2018.

*Primary Examiner* — Adam J Eiseman
*Assistant Examiner* — Stephen Floyd London
(74) *Attorney, Agent, or Firm* — Stiennon & Stiennon

(57) ABSTRACT

A blade segment (4, 8, 8*a*, 8*b*) for a refiner comprises an inner end edge (20) and an outer end edge (21) and a first side edge (22) and a second side edge (23) opposite to the first side edge (22), the first side edge (22) and the second side edge (23) extending between the inner end edge (20) and the outer end edge (21), and a refining surface (29) comprising blade bars (27) and blade grooves (28) therebetween on a front surface (25) of the blade segment (4, 8, 8*a*, 8*b*). At least one side edge (22, 23) of the blade segment (4, 8, 8*a*, 8*b*) comprises at least one opening (14*a*, 14*b*, 14*c*, 14*d*, 14*e*, 14*f*, 14*g*) that extends from the side edge (22, 23) toward the opposite side edge (22, 23).

28 Claims, 3 Drawing Sheets

(56) References Cited

U.S. PATENT DOCUMENTS

| | | | | | |
|---|---|---|---|---|---|
| 4,039,154 | A * | 8/1977 | Peterson | D21D 1/306 | 241/261.3 |
| 4,676,440 | A * | 6/1987 | Perkola | D21D 1/306 | 241/261.3 |
| 5,383,617 | A * | 1/1995 | Deuchars | B02C 7/12 | 241/261.2 |
| 5,863,000 | A * | 1/1999 | Gingras | B02C 7/12 | 241/261.2 |
| 2004/0149844 | A1* | 8/2004 | Antensteiner | D21D 1/303 | 241/298 |
| 2006/0192040 | A1 | 8/2006 | Johansson | | |
| 2007/0084952 | A1* | 4/2007 | Sjostrom | B02C 7/12 | 241/261.2 |
| 2008/0296419 | A1* | 12/2008 | Gingras | D21D 1/30 | 241/28 |
| 2009/0302140 | A1* | 12/2009 | Johansson | B02C 7/12 | 241/28 |
| 2012/0018549 | A1 | 1/2012 | Gingras | | |
| 2012/0032011 | A1* | 2/2012 | Ruola | D21D 1/306 | 241/277 |
| 2013/0306770 | A1* | 11/2013 | Sjostrom | D21D 1/22 | 241/245 |

FOREIGN PATENT DOCUMENTS

| | | | |
|---|---|---|---|
| EP | 2304101 | A1 | 4/2011 |
| EP | 2326767 | A1 | 6/2011 |
| EP | 3103916 | A1 | 12/2016 |
| WO | 2009153412 | A1 | 12/2009 |
| WO | 2009153413 | A1 | 12/2009 |
| WO | 2012101330 | A1 | 8/2012 |
| WO | 2016066894 | A1 | 5/2016 |

* cited by examiner

BLADE SEGMENT FOR REFINER

CROSS REFERENCES TO RELATED APPLICATIONS

This application claims priority from Finnish application FI 20175426 filed on May 11, 2017, which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to refiners for refining fibrous material and especially to a blade segment for a refiner for refining fibrous material.

Refiners used for refining fibrous material, such as refiners used for manufacturing mechanical pulp or in low consistency refining, are typically formed of two refining elements opposite to each other and turning relative to each other, i.e. one or both of them is/are rotating. The refining elements comprise refining surfaces provided with blade bars and blade grooves therebetween, the blade bars being intended to defiber and refine the material to be refined and the blade grooves being intended to convey the material to be refined forward along the refining surfaces. The refining surface of the refining element is typically formed of several blade segments to be fastened to a body of the refining element. The complete refining surface of the refining element is thus formed of the refining surfaces of several blade segments fastened next to each other in the refining element.

A prior art blade segment, such as disclosed in EP-publications 2304101 and 2326767, further comprises openings arranged through the blade segment in a middle section of the refining surface of the blade segment. The openings extend over the thickness of the blade segment, in other words from a background surface of the blade segment up to the refining surface. The openings are intended either for feeding the fibrous material to be refined through the openings into a refining gap between opposite refining elements or for discharging the fibrous material already refined from the refining gap through the openings. The openings thus allow flow of fiber material into and/or out of the refiner. There are however challenges in manufacturing of such a blade segment.

SUMMARY OF THE INVENTION

An object of the present invention is to provide a novel blade segment for a refiner.

The blade segment according to the invention is for a refiner for refining fibrous material and has an inner end edge and an outer end edge, a first side edge and a second side edge opposite to the first side edge, wherein the first side edge and the second side edge extending between the inner end edge and the outer end edge, and further having a refining surface comprising blade bars and blade grooves therebetween on a front surface of the blade segment, wherein at least one of the side edges of the blade segment has at least one opening that extends from the side edge toward the opposite side edge.

The invention is based on the idea of having the openings to be arranged through the blade segment being located at one or the other side edge or at both side edges of the blade segment.

An advantage of the invention is that the manufacturing of the blade segments by casting is much easier than the manufacturing of the prior art blade segments comprising opening in the middle section of the refining surface of the blade segment. Also, the rigidity of the blade segment is higher than the prior art blade segment.

BRIEF DESCRIPTION OF THE DRAWINGS

In the following the invention will be described in greater detail by means of preferred embodiments with reference to the accompanying drawings, in which.

DESCRIPTION OF THE PREFERRED EMBODIMENTS

Figure 1:
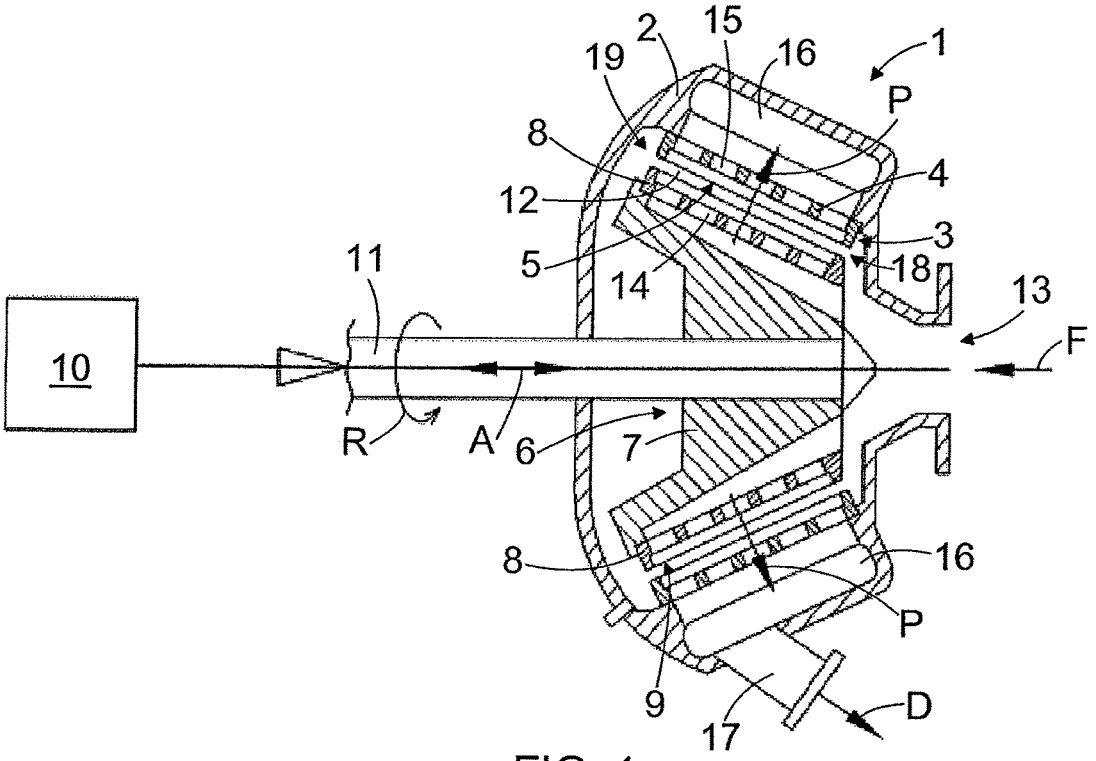
FIG. 1 is a schematic general side view of a conical refiner in cross-section.

For the sake of clarity, the figures show some embodiments of the invention in a simplified manner. Like reference numerals identify like elements in the figures.

FIG. 1 is a schematic general side view of a general construction of a refiner 1, which may be used for refining a fibrous material, such as a wood material containing lignocellulose or another material suitable to be used for manufacturing paper or paperboard, for example. The refiner 1 shown in FIG. 1 is of conical type but disc-refiners, conical-disc-refiners and cylindrical refiners could be used as well as an example here. The conical refiner of FIG. 1 comprises two refining elements 3, 6 at least one of which is rotating. In the following a refiner with one rotating element only is described. It comprises a frame 2 and a stationary, fixed refining element 3, i.e. a stator 3 supported on the frame 2. The stationary refining element 3 comprises several blade segments 4 each comprising blade bars and blade grooves therebetween, the blade bars and the blade grooves in each blade segment 4 forming a part of a refining surface 5 of the stationary refining element 3. A complete refining surface 5 of the stationary refining element 3 is formed of blade bars and blade grooves of a necessary number of the blade segments 4 fastened next to each other in the stationary refining element 3 so that a complete refining surface extending over the whole circumference of the stationary refining element 3 is provided.

The refiner 1 further comprises a rotatable refining element 6, i.e. a rotor 6, of the refiner 1. The rotatable refining element 6 comprises a body 7 and several blade segments 8 comprising blade bars and blade grooves therebetween, the blade bars and the blade grooves in each blade segment 8 forming a part of a refining surface 9 of the rotatable refining element 6. A complete refining surface 9 of the rotatable refining element 3 is formed of blade bars and blade grooves of a necessary number of the blade segments 8 fastened next to each other in the rotatable refining element 6 so that a complete refining surface 9 extending over the whole circumference of the rotatable refining element 6 is provided.

The body 7 of the rotatable refining element 6 is connected to a motor 10 by a shaft 11 so that the rotatable refining element 6 can be rotated relative to the stationary refining element 3 in a direction of arrow R, for instance, the arrow R thus indicating an intended rotation direction R of the rotatable refining element 6.

The refiner 1 may also comprise a loader which, for the sake of clarity, is not shown in FIG. 1. The loader can be used for moving back and forth the rotatable refining element 6 attached to the shaft 11, as schematically shown by arrow A, in order to adjust the size of a refining gap 12 between the stationary refining element 3 and the rotatable refining element 6.

The fibrous material to be refined is fed into the refiner 1 via a feed channel 13 in a manner shown by arrow F. In one embodiment a majority of the fibrous material fed into the refiner 1 passes, in a manner schematically shown by arrows P, through openings 14 formed through the blade segments 8 in the rotatable refining element 6 into the refining gap 12, in which the fibrous material is to be refined. The already refined material is, in turn, able to pass through openings 15 formed through the blade segments 4 in the stationary refining element 3 into an intermediate space 16 between the frame 2 of the refiner 1 and the stationary refining element 3, wherefrom the refined material is removed via a discharge channel 17 from the refiner 1, as schematically shown by arrow D.

Since the space between the rotatable refining element 6 and the frame 2 of the refiner 1 is not fully closed, some of the fibrous material being fed into the refiner 1 may transfer into the refining gap 12 from the right end of the refining gap 12, i.e. from a first end 18 or an inner end 18 of the refiner 1 having a smaller diameter, as seen in FIG. 1. Correspondingly, some of the already refined material may also exit the refining gap 12 from the left end of the refining gap 12, i.e. from a second end 19 or an outer end 19 of the refiner 1 having a larger diameter, as seen in FIG. 1, wherefrom a connection is provided to the intermediate space 16 between the frame 2 of the refiner 1 and the stationary refining element 3.

In the embodiment of FIG. 1 of the refiner 1, only one feed channel 13 is provided, and it is arranged at the first end 18 of the refiner 1 having the smaller diameter. The actual implementation of the refiner could also comprise a second feed channel arranged at the second end 19 of the refiner 1 having the larger diameter, whereby the discharge channel 17 of the refiner 1 could be arranged for example somewhere between the first 18 and second 19 ends of the refiner 1. In the following, the reference sign 18 and the term first end 18 or the term inner end 18 may indicate both the first end 18 or the inner end 18 of the refiner 1 having the smaller diameter and the first ends 18 or the inner ends 18 of the refining elements 3, 6 having the smaller diameter. Similarly, the reference sign 19 and the term second end 19 or the term outer end 19 may indicate both the second end 19 or the outer end 19 of the refiner 1 having the larger diameter and the second ends 19 or the outer ends 19 of the refining elements 3, 6 having the larger diameter.

It is emphasized that in addition to the conical refiners disclosed above the blade segment of the solution described herein may be applied in other kinds of conical refiners too. In addition to the conical refiners the blade segment of the solution described herein is applicable to disc refiners and cylindrical refiners and to refiners comprising both a conical portion and a disc portion, as well.

Figure 2:
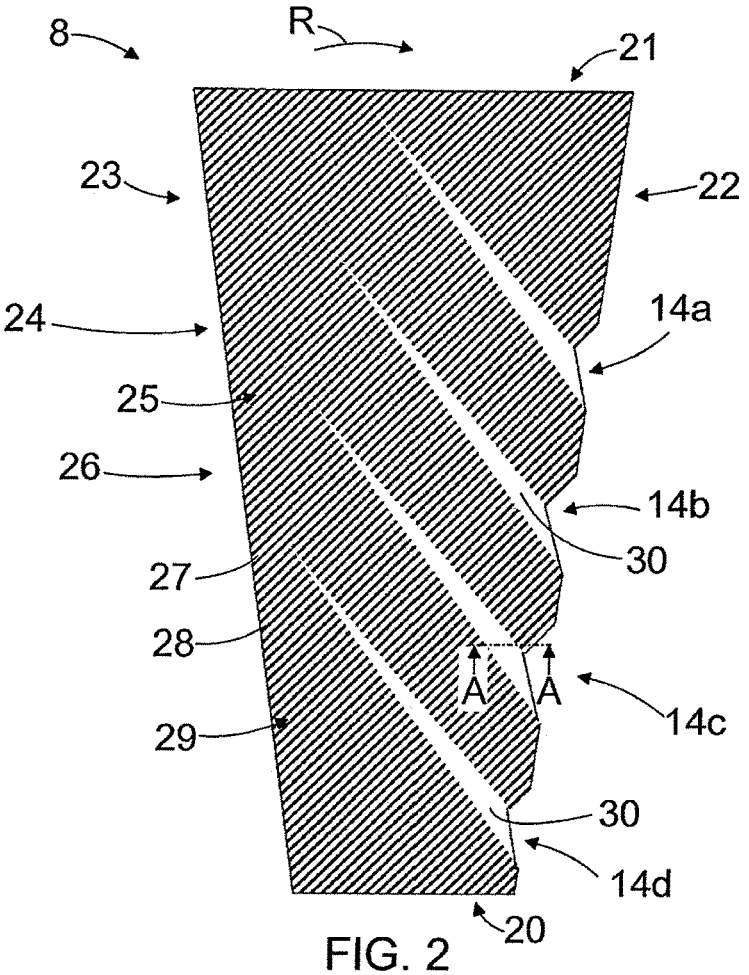
FIG. 2 is a schematic front view of a blade segment.

FIG. 2 is a schematic front view of a blade segment 8 for the rotatable refining element 6. The blade segment 8 comprises an inner end edge 20 or a first end edge 20 to be directed toward the inner end 18 of the rotatable refining element 6 having the smaller diameter. The blade segment 8 further comprises an outer end edge 21 or a second end edge 21 to be directed toward the outer end 19 of the rotatable refining element 6 having the larger diameter. The inner end edge 20 of the blade segment 8 provides a radially inner end 20 of the blade segment 8 and the outer end edge 21 of the blade segment 8 provides a radially outer end 21 of the blade segment 8, the direction from the radially inner end 20 toward the radially outer end 21 thus providing the radial direction of the blade segment 8.

The blade segment 8 further comprises a first side edge 22 or a leading side edge 22 extending from the inner end edge 20 of the blade segment 8 up to the outer end edge 21 of the blade segment 8 and providing the side edge of the blade segment 8 to be directed toward the intended rotation direction R of the rotatable refining element 6. The blade segment 8 further comprises a second side edge 23 or a trailing side edge 23 opposite to the first side edge 22 and extending from the inner end edge 20 of the blade segment 8 up to the outer end edge 21 of the blade segment 21. The second side edge 23 of the blade segment 8 provides the side edge of the blade segment 8 to be directed toward the direction that is opposite to the intended rotation direction R of the rotatable refining element 6. The inner 20 and the outer 21 end edges together with the first 22 and second 23 side edges define a periphery of the blade segment 8.

The blade segment 8 comprises a body 24 of the blade segment 8 having a front surface 25 to be directed toward the refining gap 12 of the refiner and a background surface 26 to be directed toward the body 7 of the rotatable refining element 6. The front surface 25 of the blade segment body 24 is provided with blade bars 27 and blade grooves 28 which together provide the refining surface 29 of the blade segment 8. The blade bars 27 are intended to defiber and refine the material to be refined and the blade grooves 28 are intended to convey the material to be refined forward along the refining surface 29. Unlike depicted in FIG. 2 and later in FIGS. 3 and 4, the blade segment 8 need not be patterned with refining bars 27 and grooves 28 from the inner end edge 20 up to the outer end edge 21. The portion close to the inner end edge 20 may be plain or it may comprise a rougher bar pattern. For example, a portion of the blade segment 8 close to the inner end edge 20 may comprise a few very rough feed bars. Any pattern of bars 27 and grooves 28 of the art is possible to apply here, those are well known to a skilled person.

In the blade segment 8 of FIG. 2, the first side edge 22 of the blade segment 8 comprises a number of openings 14, and to be more exact, openings 14*a*, 14*b*, 14*c*, 14*d*, that extend from the first side edge 22 toward the opposite second side edge 23. In other words, there are openings 14, i.e. openings 14*a*, 14*b*, 14*c*, 14*d*, or indents, at the first side edge 22 of the blade segment 8 such that the first side edge 22 does not provide a straight line between the inner end edge 20 and the outer end edge 21. The openings 14*a*, 14*b*, 14*c*, 14*d* extend from the refining surface 29 of the blade segment body 24 up to the rear or background surface 26 of the blade segment body 24, the openings 14*a*, 14*b*, 14*c*, 14*d* thus extending through a whole thickness of the blade segment 8. Later in FIGS. 5*a* and 5*b* it is shown schematically some possible different embodiments of a cross-section of the blade segment 8.

The blade segment 8 of FIG. 2 or the refining surface 29 of the blade segment 8 of FIG. 2 further comprises feed grooves 30. The feed groove 30 is arranged to extend from the opening 14*a*, 14*b*, 14*c*, 14*d* arranged in the first side edge 22 of the blade segment 8 toward at least one other edge of the blade segment 8. In the embodiment of FIG. 2 each feed groove 30 is arranged to extend obliquely from the respective opening 14 toward both the second side edge 23 and the outer end edge 21. Each opening 14 and the respective groove 30 form a flow connection so that the material to be refined and supplied from the side of the background surface 26 of the blade segment 8 toward the front surface 25 of the blade segment 8 through the openings 14*a*, 14*b*, 14*c*, 14*d* enters into the respective feed groove 30 and flows along the feed groove 30 toward a central portion of the blade segment 8. At the same time, when the blade segment 8 rotates along the rotatable refining element 6, forces affecting on the material flowing in the feed groove 30 force the material away from the feed groove 30 into the blade grooves 28 remaining between the blade bars 27, thus distributing the material to be refined on the refining surface 29 of the blade segment 8. For sake of better material distribution, it is preferred that the feed groove 30 crosses the refining blade bars 27 and grooves 28 at an angle that is preferably from 90 to ±45 degrees.

In the embodiment of FIG. 2 the openings 14 and the grooves 30 are lying on the same side edge 22. The openings 14 and the grooves 30 may however lie on opposite side edges 22, 23 of the blade element 8, so that the second side edge 23 is provided with openings 14 whereas the first side edge 22 is provided with grooves 30, as shown in FIG. 3.

Figure 3:
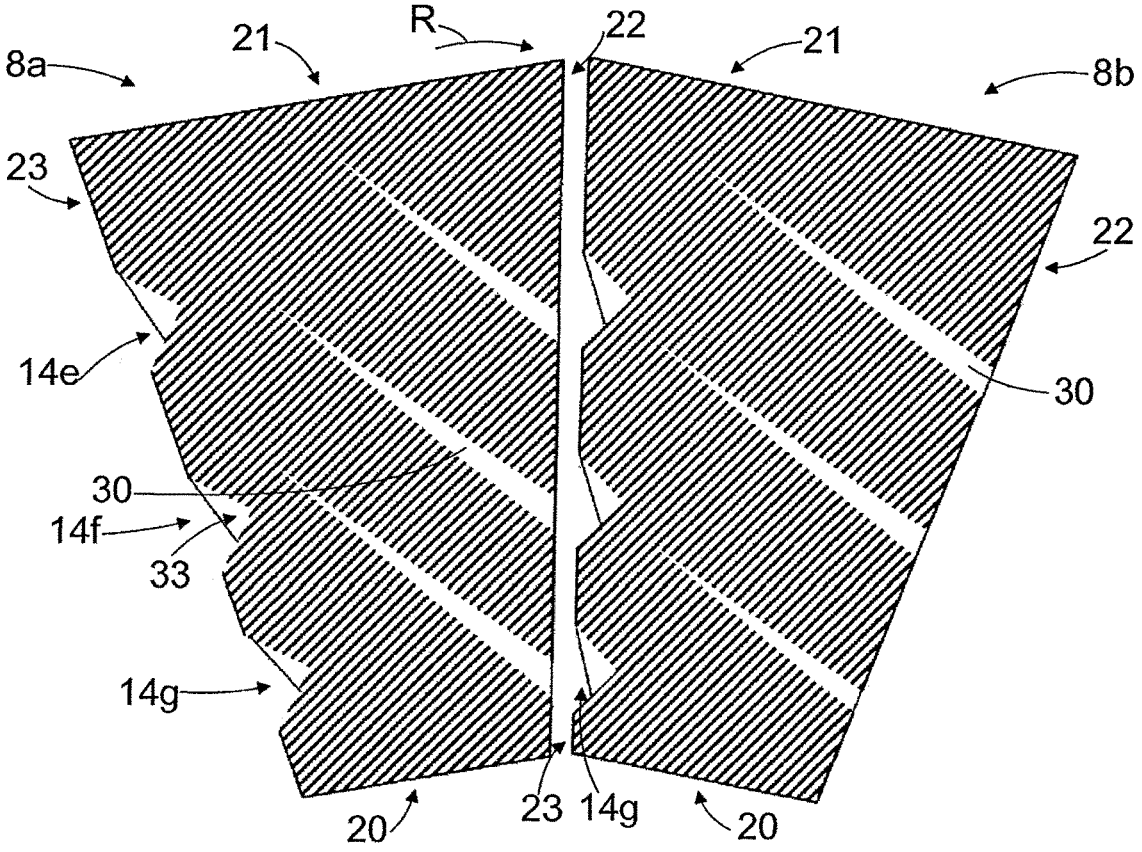
FIG. 3 is a schematic front view of a set of two neighboring blade segments of another embodiment of a blade segment.

FIG. 3 is a schematic front view of a set of two neighboring blade segments 8*a*, 8*b* of another embodiment of the invention. FIG. 3 shows the two neighboring blade segments 8*a*, 8*b* in the position relative to each other where they lie when installed to the rotatable refining element 6, with an exception, however, that in FIG. 3 there is a clearance between the neighboring blade segments 8*a*, 8*b*, which clearance does not exist in practice when the blade segments are assembled tightly side-by-side.

In the embodiment of FIG. 3 the blade segments 8*a*, 8*b* comprise openings 14, and to be more exact, openings 14*e*, 14*f*, 14*g*, on the second side edge 23 thereof. In other words, there are openings 14, i.e. openings 14*e*, 14*f*, 14*g*, or indents, at the second side edge 23 of the blade segment 8*a*, 8*b* such that the second side edge 23 does not provide a straight line between the inner end edge 20 and the outer end edge 21. Furthermore, the blade segments 8*a*, 8*b* comprise feed grooves 30 that are arranged to extend from the first side edge 22 obliquely toward both the second side edge 23 and the outer end edge 21. An end of each feed groove 30 at the first side edge 22 of the blade segment 8*a*, 8*b* lies at a radial position corresponding to a radial position of the respective opening 14*e*, 14*f*, 14*g* at the second side edge 23 of the blade segment 8*a*, 8*b*. When the two neighboring blade segments 8*a*, 8*b* are set next to each other side-by-side, as shown in FIG. 3, the openings 14*e*, 14*f*, 14*g* in the right-hand side blade segment 8*b* will be set next to the feed grooves 30 in the left-hand side blade segment 8*a*. The operation of the rotatable refining element 6 provided with blade segments 8*a*, 8*b* of FIG. 3 will thus be similar to that of the rotatable refining element 6 provided with blade segments 8 of FIG. 2.

By proper alignment of the feed grooves 30 on the refining surface 29 it is possible to affect the flow of the material to be refined on the refining surface 29. In the embodiments of FIGS. 2 and 3, wherein the blade segment 8, 8*a*, 8*b* is intended to provide a part of the refining surface 9 of the rotatable refining element 6 and wherein the feed grooves 30 are arranged to extend from the first side edge 22 of the blade segment 8, 8*a*, 8*b* partly toward the outer end edge 21 of the blade segment 8, 8*a*, 8*b*, the material flowing on the refining surface 29 of the blade segment 8, 8*a*, 8*b* will have a tendency of moving toward the outer end edge 21 of the blade segment 8, 8*a*, 8*b*. Thereby the material to be refined will flow faster toward the second end 19 of the refiner 1 having the larger diameter and out of the refining gap 12 of the refiner 1 at the second end 19 of the refiner 1.

In another possible embodiment of the blade segment 8, 8*a*, 8*b*, wherein the blade segment 8, 8*a*, 8*b* would also be intended to provide a part of the refining surface 9 of the rotatable refining element 6 but wherein the feed grooves 30 would be arranged to extend from the first side edge 22 of the blade segment 8, 8*a*, 8*b* obliquely partly toward the inner end edge 20 of the blade segment 8, 8*a*, 8*b*, the material flowing on the refining surface 29 of the blade segment 8, 8*a*, 8*b* will have a tendency of moving toward the inner end edge 20 of the blade segment 8, 8*a*, 8*b*. Thereby the material to be refined will flow slower toward the second end 19 of the refiner 1 having the larger diameter and out of the refining gap 12 of the refiner 1 at the second end 19 of the refiner 1.

In the embodiments of FIGS. 2 and 3 above either only the first side edge 22 or the second side edge 23 of the blade segment 8, 8*a*, 8*b* was provided with at least one opening 14. Additionally, however, an embodiment of the blade segment comprising at least one opening 14 both in the first side edge 22 and in the second side edge 23 of the blade segment is also possible. Then, at the first side edge 22 there would be both openings 14 and grooves 30, as in FIG. 2 and, in addition, openings 14 at the second side edge 23, too. Then, shape and size of the openings could be designed more freely.

Figure 4:
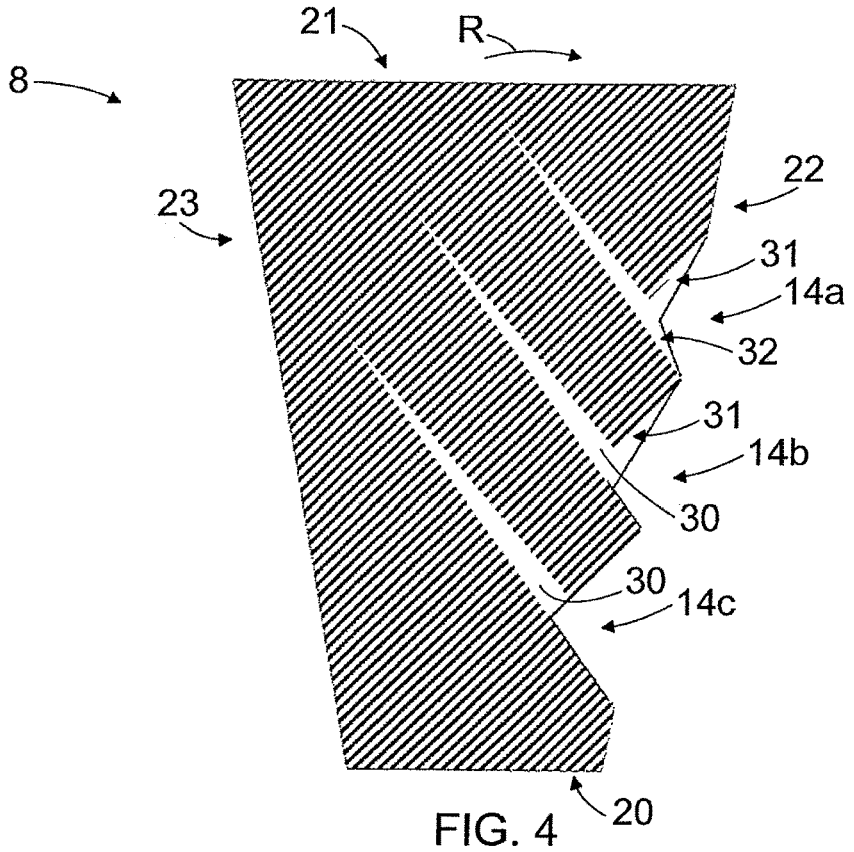
FIG. 4 is a schematic front view of a third blade segment.
Figure 5A:
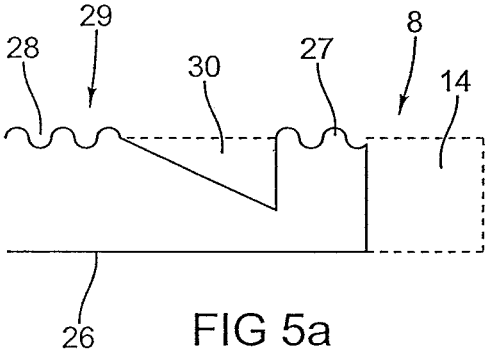
FIG. 5*a* is a schematic cross-sectional view of a part of the blade segment of FIG. 2.
Figure 5B:
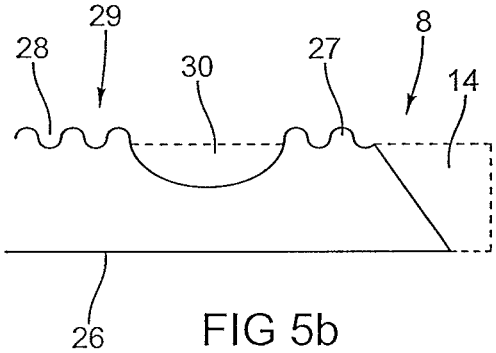
FIG. 5*b* is a schematic cross-sectional view of a part of a further embodiment of the blade segment.

FIG. 4 is a schematic front view of a third blade segment 8 for the refining element 6. A general construction of the blade segment 8 of FIG. 4 is similar to that of the blade segment 8 of FIG. 2. FIG. 5*a* is a simplified cross-sectional view of the blade segment 8 of FIG. 2, taken along line A-A in FIG. 2. FIG. 5*b* is a further embodiment of FIG. 5*a*. FIGS. 5*a*, and 5*b*, together with FIGS. 2, 3 and 4, are provided to exemplify some details of beveled edges around the openings 14 and the groove 30 as well as some variations of the groove 30 and the openings 14.

In the blade segment 8 of FIG. 4 an edge of the two radially outermost openings 14*a*, 14*b* comprise a bevel 31 that is arranged to rise from the rear side 26 toward the refining surface 29 of the blade segment 8, for example in a way as shown schematically in FIG. 5*b*. Furthermore, in the blade segment 8 of FIG. 4 and relating to the feed groove 30 at the radially outermost opening 14*a*, an edge of the end of the feed groove 30 on the side of that opening 14*a* comprises a bevel 32 that is also arranged to rise from the rear side 26 toward the refining surface 29 of the blade segment 8. The radially innermost opening 14*c* is an example of such an opening where both its edges are nonbeveled i.e. straight-cut or about vertical, for example in a way as shown schematically in FIG. 5*a*. Every combination of beveled or non-beveled edges of the openings 14 is possible: each edge of the opening 14 can be beveled, only one edge can be beveled or neither or none of them is beveled. Thus, the edges of the openings 14 may have bevels 33 in one or more directions, as shown in FIG. 3, or they can be non-beveled or straight-cut, like in FIG. 2. Likewise, the edges of the grooves 30 may be beveled, also in case when the grooves 30 are separate from the openings 14, as in the embodiment of FIG. 3. The purpose of the bevels 31, 32, 33 is to enhance the rise of the material to be refined and supplied through the opening 14 onto the refining surface 29 and into the feed groove 30.

Figure 5C:
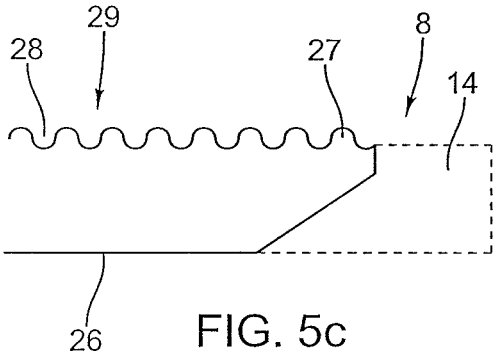
FIG. 5*c* is a schematic cross-sectional view of a part of a further embodiment of the blade segment.

Furthermore, as shown in FIG. 5*c*, the blade segments 8*a*, 8*b* of FIG. 3 may also comprise a bevel formed in the background surface 26 next to the opening 14*e*, 14*f*, 14*g*, which bevel is arranged to rise toward the opening 14*e*, 14*f*, 14*g* and is intended to enhance the flow of the material to be refined from the background side of the blade segment 8*a*, 8*b* toward the opening 14*a*, 14*b*, 14*c*.

In the embodiments disclosed above in FIGS. 2, 3 and 4 the number of the openings 14 in the first side edge 22 and in the second side edge 23 vary between three and four but the number of the openings 14 in the first side edge 22 and/or in the second side edge 23 may be any number starting from one. The upper limit for that number is to be determined practically by a minimum area required by each individual opening 14*a*, 14*b*, 14*c*, 14*d*, 14*e*, 14*f*, 14*g*, i.e. by a minimum size of each individual opening 14*a*, 14*b*, 14*c*, 14*d*, 14*e*, 14*f*, 14*g*, so that the opening does not become clogged by the material to be refined.

In the embodiments of the blade segments 8, 8*a*, 8*b* of FIGS. 2 and 3 the sizes of the openings 14, i.e. a minimum open cross-sectional area of each opening 14, are the same or about the same. In the embodiment of the blade segment 8 of FIG. 4, however, all the openings 14*a*, 14*b*, 14*c* are arranged to be of different sizes in such a way that that the size of a radially inner opening is greater than the size of a radially outer opening. This means that less material is supplied through the openings remaining closer to the radially outer end 21 of the blade segment 8 than through the openings remaining closer to the radially inner end 20 of the blade segment 8, whereby uniform refining treatment may be provided for each material portion to be fed into the refiner 1. Generally, at least some openings 14 on the side edge of the blade segment may be arranged to be of different sizes.

In the embodiments of FIGS. 2, 3 and 4, the openings 14 have a general shape of a triangle or a rectangle. Generally, the openings 14 may, however, have a number of different shapes, such as a general shape of a semicircle, a general shape of a square, or a general shape of a parallelogram or a trapezium, either with sharp or rounded edges. The opening may thus have either a fixed dimension or a varying dimension in the radial direction of the blade segment 8.

Figure 8:
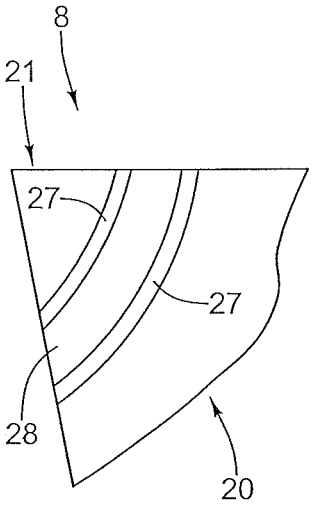
FIG. 8 is a schematic view of a part of a sixth blade segment.

In the embodiments of the blade segments 8, 8*a*, 8*b* of FIGS. 2, 3 and 4 the feed grooves 30 are arranged to run obliquely toward the outer end edge 21 of the blade segment 8. Alternatively, as shown in FIG. 8 the feed grooves 30 may also be arranged to run in a curved manner toward the outer end edge 21 of the blade segment 8. In both embodiments the feed groove 30 may be arranged to cross the blade grooves 28 of the blade segment 8, 8*a*, 8*b* at an angle of 90±45 degrees. Furthermore, as seen in FIGS. 5*a* and 5*b* the profile shape of the groove 30 may vary. The bottom and side walls of the groove 30 may form a semicircle, semi-square, semi-rectangular, sloped or any other regular or irregular profile shape. In FIG. 5*b* a groove 30 with semi-circle bottom is disclosed. In FIG. 5*a* the groove 30 has a slope bottom being deepest on the side closer to the opening 14 it is connected to and rising toward the opposite side of the groove 30. Sloping direction can be opposite, though. Design of the groove 30 direction and profile can be selected depending on the desired dwell time and refining level.

In the embodiments of the blade segment 8, 8*a*, 8*b* in the FIGS. 2, 3 and 4 width of the feed groove 30 is arranged to decrease in its running direction. Alternatively, or in addition to that, also depth of the feed groove 30 may be arranged to decrease in its running direction. A decrease in a cross-sectional area of the feed groove 30 in its running direction forces the material flowing in the feed groove 30 toward the refining gap 12 between the opposing refining elements 3, 6.

According to an embodiment of the blade segment 8, depth and/or width of a radially inner feed groove 30 may be arranged to be greater than a corresponding measure of a radially outer feed groove 30. This has the effect that more material may be supplied through the feed grooves 30 remaining closer to the radially inner end 20 of the blade segment 8 than through the feed grooves 30 remaining closer to the radially outer end 21 of the blade segment 8 but still being able to provide uniform refining treatment for each material portion be fed into the refiner 1.

FIG. 4 discloses an example of the blade segment 8 wherein width of a radially inner feed groove 30 is arranged to be greater than width of a radially outer feed groove 30. This is preferred especially when the groove 30 slopes steeply toward the outer end edge 21. However, with inclination angle of the groove 30 sloping less steeply, it is always possible to design the radially outer grooves 30 wider than the inner grooves, as shown in accordance with blade segment 8*b* of FIG. 3. The feed groove 30 is responsible for feeding an area which is wider the closer the outer end edge 21 lies, thus a wider groove 30 may enhance the distribution of the material to be refined.

Figure 6:
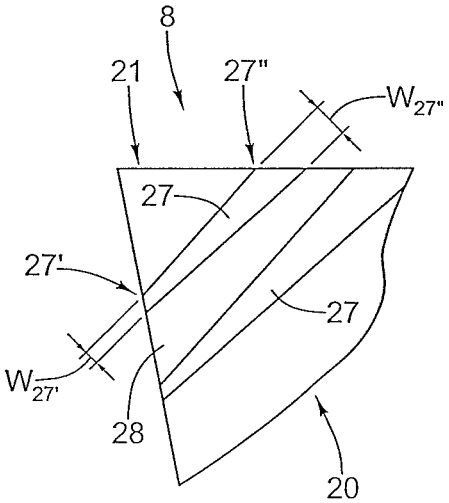
FIG. 6 is a schematic view of a part of a fourth blade segment.

FIG. 6 is a schematic view of a part of a fourth blade segment 8, and to be more exact, of a part at a left hand upper corner of the blade segment 8. The blade segment 8 of FIG. 6 may be as disclosed in FIG. 3, 4, 5 or 6 and the related description. Furthermore, in the blade segment 8 of FIG. 6 a width of the blade bars 27 is arranged to increase in their running direction, i.e. in the direction of their extension in such a way that a width W27' of the blade bar 27 at an end 27' of the blade bar 27 facing toward the inner end edge 20 of the blade segment 8 is smaller than a width W27" of the blade bar 27 at an end 27" of the blade bar 27 facing toward the outer end edge 21 of the blade segment 8. The increase in the width of the blade bar 27 in its longitudinal direction may for example be 10 to 50%, preferably 30 to 40%. This principle of the width increase of the blade bars 27 may be applied at any limited portion or at any portion of the refining surface 29 of the blade segment 8, but preferably at least close to the outer end edge 21 of the blade segment 8.

Figure 7:
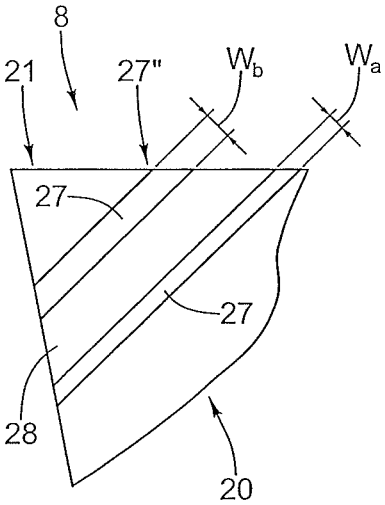
FIG. 7 is a schematic view of a part of a fifth blade segment.

FIG. 7 is a schematic view of a part of a fifth blade segment, and to be more exact, of a part at a left hand upper corner of the blade segment 8. The blade segment 8 of FIG. 7 may be as disclosed in FIG. 3, 4, 5 or 6 and the related description. Furthermore, in the blade segment 8 of FIG. 7 a width of the blade bars 27 is arranged to increase toward the outer end edge 21 of the blade segment 8 in such a way that a width $W_a$ of the blade bar 27 lying closer to the inner end edge 20 of the blade segment 8 is smaller than a width $W_b$ of the blade bar 27 lying closer to the outer end edge 21 of the blade segment 8 in a radial direction of the blade segment 8. This principle of the width increase of the blade bars 27 may be applied at any limited portion or at a whole portion of the refining surface 29 of the blade segment 8, but preferably at least close to the outer end edge 21 of the blade segment 8.

The ways of the width increase of the blade bars 27 as disclosed above may be used to provide an increased wear resistance, or in other words, to compensate the increased wear rate possibly appearing close to the outer end edge of the blade segment during the operation of the refiner.

Furthermore, according to an embodiment of a blade segment at least one of height and width of at least one blade groove 28 is arranged to change in its running direction.

Furthermore, according to an embodiment of a blade segment a mutual spacing of neighboring blade bars 27 at least at a portion in their running direction is arranged to change at least at a portion of the refining surface 29 of the blade segment.

In the embodiments above the openings 14 were provided in the blade segment 8 intended to be used in the rotatable refining element 6. Similar openings may, however, be also applied in blade segments intended to be used in the stationary refining element 3. Typically, the material to be refined may be fed into the refining gap 12 between the stationary refining element 3 and the rotatable refining element 6 through the openings 14 arranged in the blade segment 8 intended to be applied in the rotatable refining element 6 and the material already refined in the refining gap 12 may be removed away from the refining gap 12 through similar openings in the blade segment 4 intended to be applied in the stationary refining element 3. Opposite arrangement for the feed of the material to be refined into the refining gap and for the removal of the material already refined away from the refining gap is, however, also possible.

Although the invention has been disclosed above in accordance with a conical refiner it is to be understood that the disclosed solution, i.e. openings arranged in the at least one side edge of the blade segment, may also be applied in blade segments intended to disc refiners, and to refiners with both conical and flat portions, i.e. conical-disc refiners or cd-refiners, and in blade segments intended to cylindrical refiners.

A manufacturing of the blade segment as disclosed by casting is much easier than the manufacturing of blade segments of the prior art comprising openings in the middle section of the refining surface of the blade segment which had to make either by using protrusion pieces during casting or by machining the openings afterwards. With the invention machining is minimized or even totally avoided. Also, the rigidity of the blade segment as disclosed herein is higher than the rigidity of the prior art blade segment comprising openings in the middle section of the refining surface of the blade segment. The segment of the invention is less fragile at its most crucial portions.

It will be obvious to a person skilled in the art that, as the technology advances, the inventive concept can be implemented in various ways. The invention and its embodiments are not limited to the examples described above but may vary within the scope of the claims.

We claim:

1. A refiner for refining fibrous material, comprising: at least two blade segments, wherein each of the at least two blade segments further comprises: an inner end edge and an outer end edge; a first side edge and a second side edge opposite to the first side edge, the first side edge and the second side edge extending between the inner end edge and the outer end edge; wherein the blade segment has a refining surface comprising blade bars and blade grooves therebetween forming a front surface of the blade segment, and a rear surface opposite the front surface wherein a whole thickness of the blade segment is defined between the front surface and the rear surface; wherein the rear surface is arranged to mount to the refiner; and wherein at least one of the first side edge and the second side edge of the blade segment has portions forming at least one opening between the front surface and the rear surface that extends from the at least one of the first side edge and the second side edge toward the opposite second side edge or first side edge such that one of the at least one opening extends through the whole thickness of the blade segment, wherein the at least one opening is arranged to conduct fibrous material through the whole thickness of the blade segment from a source of fibrous material to the refining surface; and wherein when the at least two blade segments are assembled with the first side edge of one of the at least two blade segments abutting the second side edge of another of the at least two blade segments to form an abutment, the one of the at least one opening of one of the at least two blade segments which extends through the whole thickness of the blade segment is located at the abutment; and at least one feed groove on the refining surface of one of the at least two blade segments, the at least one feed groove communicating with and extending away from the one of the at least one opening and the at least one feed groove cutting across the blade grooves and bars on the refining surface of the one of the blade segments of the at least two blade segments, the at least one feed groove having a depth greater than the blade grooves and wherein the at least one feed groove extends obliquely in a running direction toward both the outer end edge and the side edge of the one of the at least two blade segments.

2. The refiner of claim 1 wherein one of the at least one opening is on the second side edge of one of the at least two blade segments and the at least one feed groove is on another of the at least two blade segments and extends obliquely toward both the outer end edge and the second side edge of the other of the at least two blade segments.

3. The refiner of claim 1 wherein a radial direction is defined extending from the inner end edge toward the outer end edge of each of the at least two blade segments and wherein the at least one opening is on the second side edge of one of the at least two blade segments and the at least one feed groove extends from the first side edge of the same one of the at least two blade segments at least partly toward the second side edge of the blade segment and wherein an end of one of the at least one feed groove at the first side edge is arranged at a radial position in the radial direction which corresponds to a radial position of one of the at least one opening at the second side edge.

4. The refiner of claim 1 wherein there are at least two openings on at least one of the first side edge and the second side edge of one of the at least two blade segments.

5. The refiner of claim 4 wherein the at least two openings are of different sizes.

6. The refiner of claim 5, wherein the at least two openings comprise a larger opening and a smaller opening, the larger opening being larger than the smaller opening, wherein the larger opening is closer to the inner end edge on the same one of the at least two blade segments than is the smaller opening.

7. The refiner of claim 1 wherein a shape of the at least one opening of one of the at least two blade segments is selected from the group consisting of: a triangle, a rectangle, a semicircle, a square, a parallelogram, and a trapezium.

8. The refiner of claim 1 wherein the at least one feed groove on one of the at least two blade segments defines a depth, a width, and a running direction away from the at least one opening of the same one of the at least two blade segments and at least one of the depth and the width decreases in the running direction.

9. The refiner of claim 8 wherein the at least one feed groove comprises: a radially inner feed groove having a depth and a width; and a radially outer feed groove having a depth and a width, and wherein at least one of the inner feed groove depth and width is greater than the corresponding outer feed groove depth and width.

10. The refiner of claim 1 wherein the at least one feed groove is arranged to cross the blade grooves at an angle of 45-135 degrees.

11. The refiner of claim 1 wherein the at least one feed groove defines a running direction and is arranged to curve toward the outer end edge of one of the at least two blade segments.

12. The refiner of claim 1 wherein the at least one feed groove has a bottom profile of the at least one feed groove and wherein the bottom profile has a shape selected from the group consisting of: a semicircle, a semi-square, a semi-rectangle, and a triangle.

13. The refiner of claim 1 wherein the at least one opening of one of the at least two blade segments has an edge below the respective refining surface and wherein there is, extending from the edge, a bevel which rises toward the refining surface.

14. The refiner of claim 1 wherein the at least one opening of one of the at least two blade segments has a first edge below the respective refining surface and extending from the first edge a first bevel which rises toward the refining surface, and wherein the at least one opening has a second edge below the refining surface and extending from the second edge, a second bevel which rises toward a portion of the refining surface which forms an end of the at least one feed groove.

15. The refiner of claim 1 wherein a width of the blade bars is arranged to increase in a running direction toward the outer end edge of one of the at least two blade segments.

16. The refiner of claim 1 wherein a radial direction is defined extending from the inner end edge toward the outer end edge of each of the at least two blade segments, and the respective blade bars have a width which increases from one bar to the next in the radial direction toward the outer end edge.

17. The refiner of claim 1 wherein one of the at least one opening is on the first side edge of one of the at least two blade segments and one of the at least one feed groove extends from the one of the at least one opening at least partly toward the second side edge on the same one of the at least two blade segments.

18. The refiner of claim 1 wherein the at least one opening is on the second side edge of one of the at least two blade segments and the at least one feed groove is arranged extending from the first side edge of another of the at least two blade segments such that the at least one opening is on the one of the at least two blade segments and the at least one feed groove is on the other of the at least two blade segments.

19. The refiner of claim 1 wherein the at least one feed groove defines a depth and a width, and wherein at least one of the depth and the width decreases in the running direction.

20. The refiner of claim 1 wherein one of the at least one opening is on the first side edge of one of the at least two blade segments and the at least one feed groove extends obliquely toward both the outer end edge and the second side edge of the same one of the at least two blade segments.

21. A pair of refiner blade segments for mounting within a refiner for refining fibrous material, comprising: a first blade segment comprising: an inner end edge and an outer end edge; a first side edge and a second side edge opposite to the first side edge, the first side edge and the second side edge extending between the inner end edge and the outer end edge; a refining surface comprising blade bars and blade grooves therebetween forming a front surface of the first blade segment, and a rear surface opposite the front surface wherein a whole thickness of the first blade segment is defined between the front surface and the rear surface; wherein the rear surface is arranged to mount to the refiner; and wherein at least one of the first side edge and the second side edge of the first blade segment has portions forming a first opening between the front surface and the rear surface that extends from the at least one of the first side edge and the second side edge toward the opposite second side edge or first side edge such that the first opening extends through the whole thickness of the first blade segment, wherein the first opening is arranged to conduct fibrous material through the whole thickness of the first blade segment from a source of fibrous material to the refining surface; and a second blade segment comprising: an inner end edge and an outer end edge; a first side edge and a second side edge opposite to the first side edge, the first side edge and the second side edge extending between the inner end edge and the outer end edge; a refining surface comprising blade bars and blade grooves therebetween forming a front surface of the second blade segment, and a rear surface opposite the front surface wherein a whole thickness of the second blade segment is defined between the front surface and the rear surface; wherein the rear surface is arranged to mount to the refiner; and wherein at least one of the first side edge and the second side edge of the second blade segment has portions forming a first opening between the front surface and the rear surface that extends from the at least one of the first side edge and the second side edge toward the opposite second side edge or first side edge such that the first opening extends through the whole thickness of the second blade segment, wherein the first opening is arranged to conduct fibrous material through the whole thickness of the second blade segment from a source of fibrous material to the refining surface; and a feed groove on the refining surface, the feed groove cutting across the blade grooves and bars on the refining surface, the feed groove having a depth greater than the blade grooves and wherein the feed groove extends obliquely in a running direction toward both the outer end edge and the side edge of the second blade segment; and wherein when the pair of blade segments are assembled with the first side edge of one of the first or second blade segments abutting the second side edge of the other of the first or second blade segments to form an abutment, the first opening of either the first or second blade segments which extends through the whole thickness of the respective first or second blade segment is located at the abutment; and the feed groove on the second blade segment communicates and extends away from said first opening of either the first or second blade segment located at the abutment.

22. The pair of refiner blade segments of claim 21 wherein the first opening of the first blade segment is on the second side edge of the first blade segment and the feed groove is on the second blade segment and extends obliquely toward both the outer end edge and the second side edge of the second blade segment.

23. The pair of refiner blade segments of claim 21 wherein a radial direction is defined extending from the inner end edge toward the outer end edge of each of the pair of refiner blade segments, and wherein the first opening is on the second side edge of the first blade segment and the feed groove extends from the first side edge of the second blade segment at least partly toward the second side edge of the second blade segment and wherein an end of the feed groove at the first side edge is arranged at a radial position in the radial direction which corresponds to a radial position of the first opening at the second side edge.

24. The pair of refiner blade segments of claim 21 wherein there are portions of the first or second blade segments which define a second opening which extends through the whole thickness of said first or second blade segments, the first opening and the second opening being both positioned on either the first side edge or the second side edge said first or second blade segments.

25. The pair of refiner blade segments of claim 24 wherein the first opening and the second opening are of different sizes.

26. The pair of refiner blade segments of claim 25, wherein the first opening and the second opening comprise a larger opening and a smaller opening, the larger opening being larger than the smaller opening, wherein the larger opening is closer to the inner end edge on the said first or second blade segments than is the smaller opening.

27. The pair of refiner blade segments of claim 21 wherein the feed groove defines a width, and wherein the running direction is away from the first opening and at least one of the depth and the width decreases in the running direction.

28. The pair of refiner blade segments of claim 21 wherein the feed groove on the refining surface of the second blade segment is arranged to cross the blade grooves at an angle of 45-135 degrees.

* * * * *